United States Patent [19]

Cloran

[11] Patent Number: 4,826,178

[45] Date of Patent: May 2, 1989

[54] NET GAME WITH CENTRAL NET OPENING

[76] Inventor: Scott Brian Cloran, 1930 Hillside Dr., Orange City, Fla. 32763

[21] Appl. No.: 165,294

[22] Filed: Mar. 8, 1988

[51] Int. Cl.[4] ..... A63B 71/00; A63B 61/00

[52] U.S. Cl. ..... 273/411; 273/29 B

[58] Field of Search ..... 273/411, 29 B, 30

[56] References Cited

U.S. PATENT DOCUMENTS

| | | | |
|---|---|---|---|
| 755,936 | 3/1904 | Ricau | 273/30 |
| 2,822,176 | 2/1958 | Robes | 273/411 X |
| 4,457,513 | 7/1984 | Thompson | 273/411 |

OTHER PUBLICATIONS

*Kick The Can,* by Darwin A. Hindman, Prentice-Hall, Inc. pp. 254–259 and 268.

*Primary Examiner*—William H. Grieb

*Attorney, Agent, or Firm*—Warren L. Franz

[57] ABSTRACT

A ball game has a rectangular net disposed in a vertical plane above the centerline of a playing area between opposite serving area ends of game court. The net has a rectangular central opening, running five-sixths the length and one-fifth the width of the net. A ball of diameter larger than one-third the width of the net opening is directed back and forth selectively either over or through the net between opponent players using apertured rackets.

20 Claims, 2 Drawing Sheets

NET GAME WITH CENTRAL NET OPENING

This invention relates to a game, such as a racket and ball game, in which a projectile is directed back and forth between players located on opposite sides of a net; and, more particularly, to an improved game in which a central opening is provided in the net to permit plays both over and through the net.

SUMMARY OF THE INVENTION

The invention provides a game that can be played either as a recreational game or as a professional sport. The game can be played indoors or out-of-doors. The game is preferably played by two teams, with ten players on each team. The object of the game is to score as many points as possible within the 60 minutes playing time.

The instruments used to play the game are a ball, rackets and a net. The net is held up by a pole at each end and includes a central opening through which the ball may be optionally played. The rackets are used to hit the ball over or through the net, thus allowing the players to score points. The pace of play will depend on the players. The game is fast and demands total concentration from the players. The more experience that players have, the faster the game will be played. The game is structured to let its participants strive for the best maneuverability and strategic play that a team or players can perform. It is governed by Rules, as set forth below.

BRIEF DESCRIPTION OF THE DRAWINGS

FIG. 2 also shows the length of the poles above and below ground level.

DETAILED DESCRIPTIONOF PREFERRED EMBODIMENT

An embodiment of the game of the invention is discussed for purposes of illustration and description with reference to FIGS. 1–4.

Figure 1:
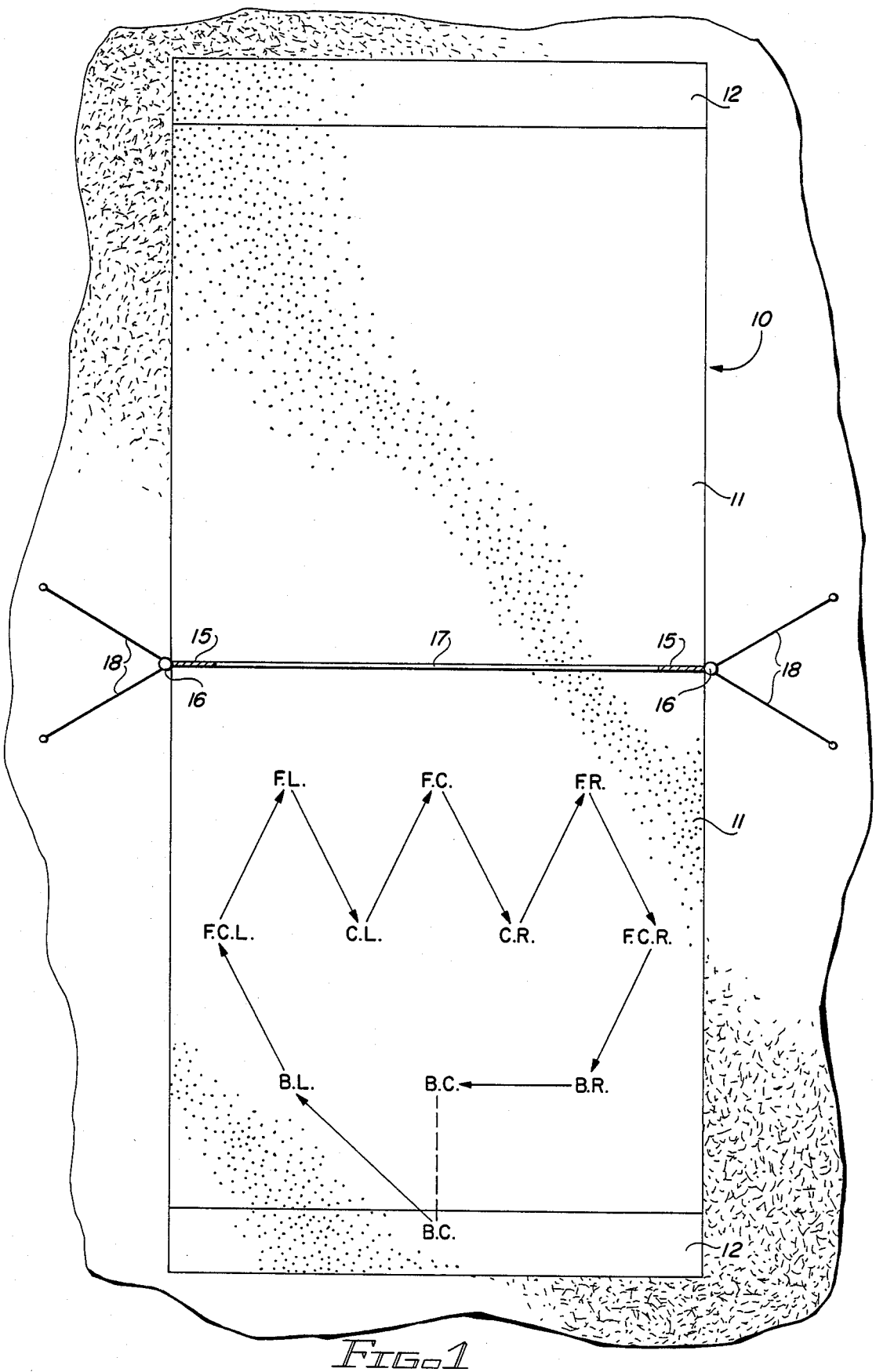
FIG. 1 shows the areas of the court of an embodiment of the game of the invention, along with player positions and the order of rotation. It also shows the net with the poles and anchor ropes.
Figure 2:
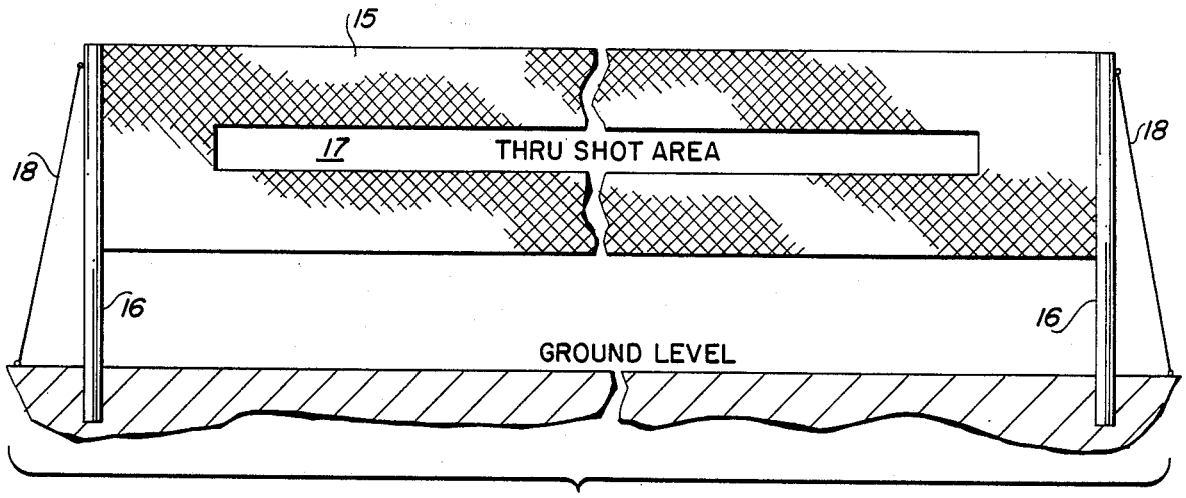
FIG. 2 shows an enlarged view of the net "thru-shot" area and the relative dimensions of the of FIG. 1.

FIG. 1 shows a court 10 made up of two areas, the playing area 11 and the service area 12. The playing area 11 measures 72 feet long and 36 feed wide. The service areas 12 measure 4 feet in the court length direction and 36 feet in the court width direction. The entire court measures 80 feet long and 36 feed wide.

The playing area 11 is located inside the service areas 12. This is the only part of the court 10 that is in-bounds while a ball 14 (FIG. 4) is in play. A playing net 15 stretches across the center of the playing area, dividing the court into two equal halves.

A service area 12 is located at each end of the court 10, just behind the playing area. The only time a service area 12 is in-bounds, is on the serving team's side when the ball 14 is being served. At all other times, the service are is out of bounds.

The net 15 is a rectangular net disposed in a vertical plane (FIG. 2) between two vertical poles 16 positioned on opposite ends of the centerline of the court 10 (FIG. 1). Net 15 is 36 feet long and 5 feet wide and is elevated 3 feet above the ground across the width of court 10. The poles 16 are each $9\frac{1}{2}$ feet long, with 8 feet extending above the ground and $1\frac{1}{2}$ feet below the ground. The net 14 has a central rectangular opening 17 which provides a "thru-shot" area so that ball 14 can be selectively directed either over the net or through the opening 17. The opening is 30 feet long and 1 foot wide, located 2 feet from the top edge, 2 feet from the bottom edge, and 3 feet from each side edge of the net 15. The poles 16 are each secured by means of two anchor ropes 18, spaced 6 feet apart and 6 feet out at the bottom of the pole, as shown in FIG. 1.

Figure 3:
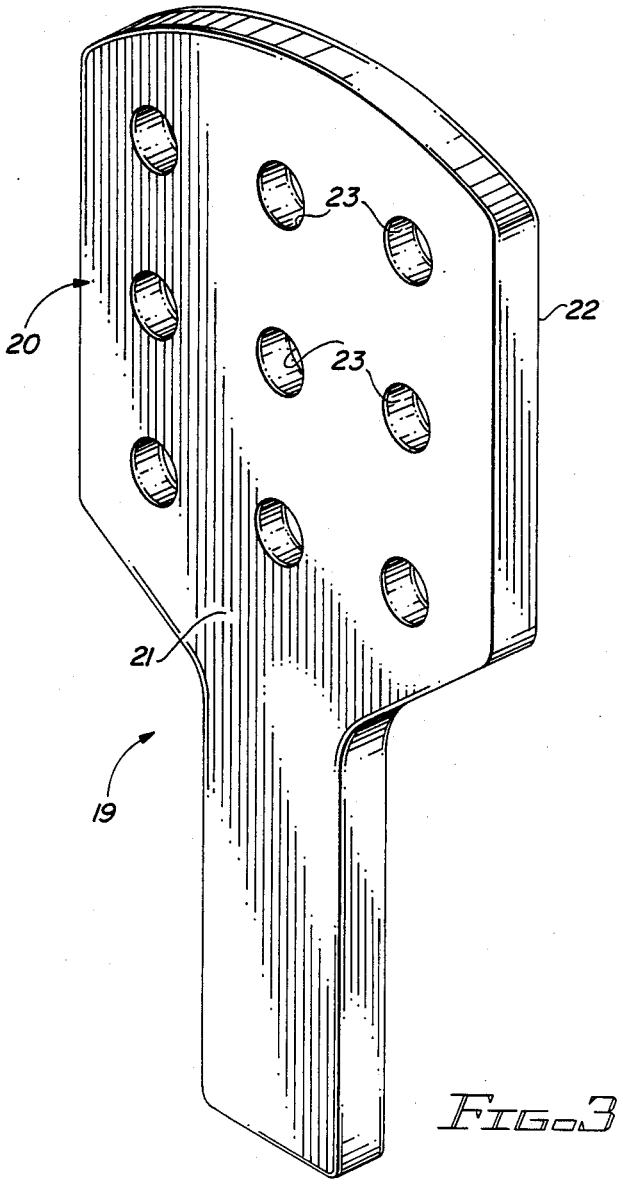
FIG. 3 shows the construction and relative dimensions of a racket usable with the court and net embodiments of FIGS. 1 and 2.
Figure 4:
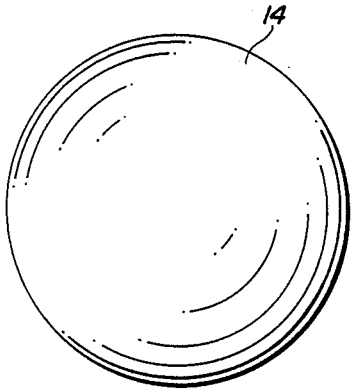
FIG. 4 shows a ball and its dimensions usable with the court and racket embodiments of FIGS. 1–3.

The ball 14 is directed over the net 15 or through the opening 17 by the players by means of a racket 19, as shown in FIG. 3. The racket 19 has a planar head 20 with front and back opposite ball striking faces 21, 22. Airway holes or apertures 23 extend through the faces 21, 22 of the head 20 for best racket maneuverability. A handle or grip 24 projects from the bottom edge in the same plane as the head 20. The illustrated racket 19 is $16\frac{3}{4}$ inches long (head top to handle bottom), 8 inches wide (head width), $\frac{3}{8}$ inches thick, and has a handle circumference of $4\frac{1}{2}$ inches a $\frac{7}{8}$ inches aperture diameter. The ball 14 (FIG. 4) has a preferred ball diameter of 5 inches.

RULES OF PLAY

There are ten players for each team. When playing with fewer players, there must be equal numbers on each side. To play an official game, ten players must play on each team.

The player positions for ten player games are indicated in FIG. 1: front left (F.L.), front center (F.C.), front right (F.R.), far center left (F.C.L.), center left (C.L.), center right (C.R.), far center right (F.C.R.), back left (B.L.), back center (B.C.), back right (B.R.) position, once the ball is served.

At each turn, a player will have three serves. Serving can be overhanded or underhanded, from anywhere within the service area. The ball 14 must go over the net 15, without any interference. If the ball 14 hits the net 15 and goes over, the serve is "dead," no points are scored and the next serve is played. If the ball 14 does not go over the net 15, hits a teammate or poles 16, or goes out of bounds, the serve is "dead" and the opposing team scores one point. If the ball 14 is served and goes over the net 15 but goes out of bounds or into the opposing sides service area 12, the ball 14 is "dead" and the opposing team scores one point. After a player serves out (three serves), the ball 14 passes to the opposing team. The only time a player can handle the ball during play, other than with the racket 19, is when the ball is being served.

When a player has served out (three serves) and the ball 14 is passed to the opposing team, the team serving out will rotate one position in a clockwise motion, as indicated by the arrows in FIG. 1. Rotation starts with the server or at back center and moves from back center to back left-far center left-front left-center left-front center-center right-front right-far center right-back right. Play will resume with the opposing team serve and rotation will continue the same way throughout the entire game.

Passing takes place when a player passes the ball 14 to a teammate. There is a maximum of three passes and/or four successive contacts with the ball 14 in order to return the ball to the opposing side.

While the ball 14 is in play after the serve, players must be within the boundaries of the playing area 11 when making contact with the ball. If a player steps out-of-bounds and then makes contact with the ball, in an attempt to return, that team will be in fault. In order for the ball 14 to be ruled out-of-bounds, it must land completely outside the boundaries of the playing area 11. If the ball 14 touches any part of the boundary lines and then goes out-of-bounds, it will be ruled in-bounds.

Playing time is accumulated while the ball 14 is in actual play. Playing time starts when the ball 14 is served and continues until the ball 14 is out of play. Any time other than when the ball 14 is in play is not considered playing time. An official game is 60 minutes playing time.

Each team will have two "time outs" per game. Only the captains of each team can call "time out." When "time out" is called, the team will have three minutes before play has to resume. During this time, the team calling "time out" has the option of changing any or all of the player's positions on its side. This is the only time during a game that players can change positions, outside a player rotation. When "time out" is called, the ball 14 must be brought back into play before another "time out" can be called by either side.

There are four quarters per game each equalling 15 minutes playing time. At the end of the first and third quarters there will be a 90 second game "time out." Play will resume with the ball 14 being served on the side according to game rotation. At the end of the second quarter or half time there will be a five minutes game "time out." When play resumes, the teams will change sides, assume the same positions prior to half time and the back center of the team having scored the least amount of points will serve the ball back into play.

There are two ways of scoring after the ball has been served: (1) Over the net: worth one point, and (2) a "thru shot": worth two points. Over the net points may be scored by "faulting" or by "having control." If, while the ball is in play, a team faults, the opposing team scores one point. If, while the ball 14 is being played over the net 15, the opposing team cannot return the ball and the ball hits the floor or ground and stays within the boundaries of the playing area," this is called "having control of the ball," and the team having control scores one point.

The only way a team can score a "thru shot" is by hitting the ball 14 through the opening 17 of the playing net 15 without touching any part of the net 15. If the ball 14 touches any part of the playing net 15, the play is "dead" and the team trying for the "thru shot" scores nothing. If a team tries and makes a "thru shot" without touching any part of the playing net 15, then the "thru shot" is "clean" and that team scores two points if the opposing team cannot return the ball. If a team makes a clean "thru shot" and the opposing team is able to return the ball, then play continues as normal. If the ball 14 is played over the net 15, then the team scores one point by over the net rules, but if the opposing team returns a "thru shot" by making a "thru shot" and the ball cannot be returned, then the team making the last clean "thru shot" scores two points.

Errors during play may occur, as follows: (1) while serving, the ball hits the net and goes over; (2) playing out of position, or (3) not making a clean "thru shot." The penalty for an error is play being stopped followed by the next serve or player rotation.

Faults during play may occur, as follows: (1) serving outside the service area; (2) a serve or return not going over the playing net; (3) hitting the ball out of bounds; (4) hitting the ball with anything other than the racket; (5) hitting the ball twice in succession by the same player; (6) reaching over the playing net with the racket; (7) touching the playing net with any part of the body or racket; (8) touching the ball with any part of the body while the ball is in play; (9) making contact with the ball, in an attempt to return, outside the boundaries of the playing area; or (10) letting the ball hit the ground or floor before returning it to the opposing side. The penalty for a fault is the automatic scoring of one point by the opposing team.

Delay of game may occur, as follows: (1) taking too much time serving; (2) taking longer than is required during "time out"; (3) taking too much time being argumentative over judgment calls; or (4) taking more than the required amount of time at the end of quarters and half time. The penalty for delay of game is loss of serve if the serving team is delaying the game or loss of one point if the opposing team is delaying the game.

Unsportsmanlike conduct will result in forfeiture of the game. Instances of unsportsmanlike conduct are: (1) deliberately breaking game equipment; (2) fighting with players, game officials or spectators; and (3) walking off the court and quitting.

A game is won by the team that has scored the most points by the end of the official 60 minutes playing time.

What is claimed is:

1. A game comprising:

an elongated net disposed in a vertical plane, with a length running horizontally and a width running vertically, and having a likewise disposed elongated opening located centrally thereof and extending for a major portion of the net length;

a projectile; and a plurality of rackets for use by players located on opposite sides of the net for directing the projectile back and forth to each other selectively over the net or through the central opening;

whereby different point counts can be awarded for plays made over the net and plays made through the net opening.

2. A game as in claim 1, wherein the net and opening are both rectangular.

3. A game as in claim 1, wherein the opening has a length at least two-thirds the length of the net.

4. A game as in claim 3, wherein the length of the opening is equal to five-sixths the length of the net.

5. A game as in claim 4, wherein the net is 36 feet long and the opening is 30 feet long.

6. A game as in claim 5, further comprising means for supporting the net at a uniformly elevated position above the ground.

7. A game as in claim 1, wherein the projectile is a ball, and wherein the opening has a width less than three times the diameter of the ball.

8. A game as in claim 7, wherein the opening is 1 foot wide and the ball is 5 inches in diameter.

9. A game as in claim 1, further comprising a game court having serving areas located at opposite ends of the court and a playing area located in between the service areas, and wherein the net is stretched across the center of the court between the ends.

10. A game as in claim 9, wherein the court is a rectangle with a length of 80 feet and a width of 36 feet, and wherein the serving areas each measure 4 feet by 36 feet.

11. In a ball game having a rectangular net disposed in a vertical plane, with a length running horizontally and a width running vertically, and a ball to be directed back and forth by ball players located on opposite sides of the net; the improvement comprising said net having a rectangular opening, with a length running horizontally and a width running vertically, located centrally thereof, and extending for a major portion of the net length, whereby the ball can be directed selectively over the net or through the central opening, permitting different point counts to be awarded for plays made over the net and plays made through the net.

12. The improvement as in claim 11, wherein the net opening has a length at least two-thirds the length of the net, and the opening has a width less than three times the diameter of the ball.

13. An improvement as in claim 12, wherein the length of the net opening is five-sixths the length of the net, and the width of the opening is one-fifth the width of the net.

14. An improvement as in claim 13, wherein the net is 36 feet long and 5 feet wide, the opening is 30 feet long and 1 foot wide, and the ball is 5 inches in diameter.

15. A ball game in which a ball is directed back and forth between players located at opposite ends of a playing area court, comprising:

a rectangular net stretching across the playing area to divide the court in half; the net being disposed in a vertical plane, with a length running horizontally and a width running vertically, and having a likewise disposed rectangular opening located centrally thereof and extending for a major portion of the net length;

a ball; and a plurality of rackets for use by the players in directing the ball selectively over the net or through the central opening; each racket having a planar head with front and back opposite ball striking faces and a handle projecting in coplanar fashion outwardly from an edge of the head, the head being apertures at the faces;

whereby different point counts can be awarded for plays made over the net and plays made through the net.

16. A ball game as in claim 15, further comprising a game court having serving areas located at opposite ends of the court and a playing area located in between the serving areas, and wherein the net is stretched across the center of the court between the ends.

17. A ball game as in claim 16, further comprising means for supporting the net at a uniformly elevated position above the court.

18. A ball game as in claim 17, wherein the opening has a length of five-sixths the lengths of the net, the opening has a width of one-fifth the width of the net, and the ball has a diameter of greater than one-third the width of the net opening.

19. A ball game as in claim 18, wherein the net is 36 feet long and 5 feet wide, the opening is 30 feet long and 1 foot wide, and the ball has a diameter of 5 inches.

20. A ball game as in claim 19, wherein the court is a rectangular court having a length of 80 feet and a width of 36 feet, and wherein each serving area is a rectangular area 4 feet by 36 feet at opposite ends of the court.

* * * * *